US008159135B2

(12) United States Patent
Yoshizawa et al.

(10) Patent No.: US 8,159,135 B2
(45) Date of Patent: Apr. 17, 2012

(54) ELECTRODE FOR HIGH PRESSURE DISCHARGE LAMP, HIGH PRESSURE DISCHARGE LAMP, AND METHOD FOR MANUFACTURING ELECTRODE FOR HIGH PRESSURE DISCHARGE LAMPTECHNICAL FIELD

(75) Inventors: Toshio Yoshizawa, Gyoda (JP); Junpei Nishimura, Gyoda (JP); Yoshiaki Kuroda, Gyoda (JP)

(73) Assignee: Iwasaki Electric Co., Ltd., Chuo-ku, Tokyo (JP)

( * ) Notice: Subject to any disclaimer, the term of this patent is extended or adjusted under 35 U.S.C. 154(b) by 0 days.

(21) Appl. No.: 13/054,872

(22) PCT Filed: Jun. 9, 2009

(86) PCT No.: PCT/JP2009/060494

§ 371 (c)(1),
(2), (4) Date: Jan. 19, 2011

(87) PCT Pub. No.: WO2010/010759

PCT Pub. Date: Jan. 28, 2010

(65) Prior Publication Data

US 2011/0121725 A1 May 26, 2011

(30) Foreign Application Priority Data

Jul. 25, 2008 (JP) ..... 2008-191786

(51) Int. Cl.
*H01J 61/06* (2006.01)
*H01J 17/04* (2006.01)

(52) U.S. Cl. ..... 313/631; 313/491; 313/326; 445/46; 445/49; 445/51

(58) Field of Classification Search ..... None
See application file for complete search history.

(56) References Cited

U.S. PATENT DOCUMENTS 5,451,837 A 9/1995 Stevens et al.
(Continued)

FOREIGN PATENT DOCUMENTS

DE 33 05 468 A1 8/1984
(Continued)

OTHER PUBLICATIONS

Notification of Transmittal of Translation of the International Preliminary Report on Patentability (Application No. PCT/JP2009/060494) dated Mar. 17, 2011.

(Continued)

*Primary Examiner* — Ashok Patel
(74) *Attorney, Agent, or Firm* — Eric J. Robinson; Robinson Intellectual Property Law Office, P.C.

(57) ABSTRACT

Provided is an electrode for a high pressure discharge lamp, which prevents spring-back of an electrode coil, and which has high productivity and high accuracy in positioning the coil. The electrode for the high pressure discharge lamp includes: an electrode core bar (30); and a coil (35) mounted on the electrode core bar, and is configured as follows. The electrode core bar (30) includes: a small-diameter section (31) on a power supply side; and a large-diameter section (32) on a leading end side. The large-diameter section (32) has: a large-diameter portion (32*a*) on the small-diameter section side; a small-diameter portion (32*b*) having a smaller outer diameter than the large-diameter portion, the small-diameter portion forming a step (s) with the large-diameter portion therebetween; and a leading end portion (32*c*). The coil (35) covers a portion between the step (s) and the leading end portion.

10 Claims, 5 Drawing Sheets

U.S. PATENT DOCUMENTS

| | | | | |
|---|---|---|---|---|
| 7,176,632 | B2 * | 2/2007 | Lenef et al. | 313/625 |
| 2007/0108911 | A1 * | 5/2007 | Hasegawa et al. | 313/631 |
| 2009/0140654 | A1 * | 6/2009 | Yamashita et al. | 313/631 |
| 2010/0039035 | A1 * | 2/2010 | Kotowicz | 313/631 |

FOREIGN PATENT DOCUMENTS

| | | | |
|---|---|---|---|
| EP | 1 148 534 | A1 | 10/2001 |
| EP | 1 798 752 | A1 | 6/2007 |
| JP | 02-174049 | | 7/1990 |
| JP | 03-110748 | | 5/1991 |
| JP | 05-054855 | | 3/1993 |
| JP | 08-087977 | | 4/1996 |
| JP | 2005-166381 | | 6/2005 |
| JP | 2007-273174 | | 10/2007 |

OTHER PUBLICATIONS

International Search Report for Application U.S. Appl. No. PCT/JP2009/060494 dated Jul. 14, 2009. Eng.

Supplementary European Search Report (Application No. 09800275.1) dated Oct. 14, 2011.

* cited by examiner

ELECTRODE FOR HIGH PRESSURE DISCHARGE LAMP, HIGH PRESSURE DISCHARGE LAMP, AND METHOD FOR MANUFACTURING ELECTRODE FOR HIGH PRESSURE DISCHARGE LAMPTECHNICAL FIELD

The present invention relates to a structure of an electrode for a high pressure discharge lamp. More specifically, the invention relates to an electrode structure for preventing the deformation of an electrode coil in a high pressure discharge lamp used for a projector.

BACKGROUND ART

FIG. 9 is a view showing a structure of a general high pressure discharge lamp such as an ultra high pressure mercury lamp. The high pressure discharge lamp 6 includes: a bulb 2 made of fused quartz; electrodes 7 disposed in a light emitting part 2*a* of the bulb 2 in a manner that the electrodes 7 face each other with an interval of 1.5 mm or less; molybdenum foils 4 disposed in sealing parts 2*b* of the bulb 2, respectively; and power supply leads 5 which are connected respectively to the molybdenum foils 4. The light emitting part 2*a* is filled with 0.15 mg/mm$^3$ or more of mercury and with $10^{-5}$ μmol/mm$^3$ to $10^{-2}$ μmol/mm$^3$ of bromine.

FIGS. 10A and 10B are cross-sectional views each showing a structure of the electrode 7 in the high pressure discharge lamp of FIG. 9. The electrode 7 includes an electrode core bar 70 and a coil 75 covering the electrode core bar 70. In FIG. 10A, the leading end side of the electrode core bar 70 is covered with the coil 75, and the leading ends of the electrode core bar 70 and the coil 75 are melted to form a dome-shaped leading end portion. Meanwhile, in FIG. 10B, the electrode core bar 70 includes a small-diameter section 71 and a large-diameter section 72. The leading end side of the large-diameter section 72 is covered with the coil 75, and the leading ends of the large-diameter section 72 and the coil 75 are melted to form a dome-shaped leading end portion.

Generally, the electrode coil has a function of adjusting the temperature of the electrode, and thereby the discharge state, discharge characteristic, and the like are determined.

The temperature of the electrode becomes high and exceeds 2000 degrees during the driving of the lamp, and the coil 75 is also thermally affected. In the configuration as shown in FIG. 10, the coil 75 may spring-back in high temperature and expand toward the molybdenum foil 4 (rightward in FIG. 10), even if the coil 75 is wound densely right after being manufactured. As the coil 75 for adjusting the electrode temperature deforms in this manner with the elapse of driving period, the temperature condition of the electrode also changes. Thus, there occurs a problem that the discharge characteristic and the like vary among the individual electrodes.

As a measure against such problem of spring-back, Patent Document 1 discloses a configuration of integrating a coil and a small-diameter section (shaft) by melting. Specifically, as disclosed in FIG. 4 of the cited example, a coil is wound around a shaft (50) into a tapered shape (54), and the tapered portion is melted to form a leading end portion (20). In addition, as disclosed in FIG. 9 of the Document, a configuration is disclosed in which not only a leading end side (122) of the coil but also a terminal end side (124) thereof is melted to a shaft (126).

CITATION LIST

Patent Document

Patent Document 1: JP-A 2007-273174

SUMMARY OF THE INVENTION

Problems to be Solved by the Invention

However, according to the configuration of Patent Document 1, the effect of preventing the spring-back can be expected. However, Patent Document 1 has a problem of poor productivity and being unsuitable for mass production because of the following reasons. Specifically, a sophisticated technique is required to wind the coil into the tapered shape. Moreover, what have to be performed are two melting steps of: melting the leading end of the coil; and melting the terminal end of the coil.

Furthermore, there is another problem that the terminal end is positioned with low accuracy because the terminal end position of the coil depends on the accuracy of the melt processing. For example, a case may be expected where the coil has its terminal end fixed while being expanded to some extent by melting heat in the melting step of the coil terminal end. In addition, the core bar may recrystallize due to heat applied thereto, reducing the strength of the recrystallized portion, and consequently breaking the electrode.

In this respect, the present invention aims to provide an electrode for a high pressure discharge lamp, which is capable of preventing spring-back of an electrode coil, and which has high productivity and high accuracy in positioning a coil terminal end.

Means for Solving the Problems

A first aspect of the present invention is an electrode for a high pressure discharge lamp, the electrode including: an electrode core bar (30); and a coil (35) covering the electrode core bar. The electrode core bar includes: a small-diameter section (31) on a power supply side; and a large-diameter section (32) on a leading end side. The large-diameter section has: a large-diameter portion (32*a*) on the small-diameter section side; a small-diameter portion (32*b*) having a smaller outer diameter than the large-diameter portion, the small-diameter portion forming a step (S) with the large-diameter portion therebetween; and a leading end portion (32*c*). The coil covers a portion between the step and the leading end portion.

A second aspect of the present invention is an electrode for a high pressure discharge lamp, the electrode including: an electrode core bar (30); and a coil (35) covering the electrode core bar. The electrode core bar includes: a small-diameter section (31) on a power supply side; and a large-diameter section (32) on a leading end side. The large-diameter section has: a leading end portion (32*c*); and a tapered portion (32*d*) which becomes smaller in diameter from the small-diameter section toward the leading end. The coil covers the tapered portion.

In the first and second aspects, the small-diameter portion (32*b*) or the tapered portion (32*d*) is formed by cut processing.

Moreover, the leading end portion (32*c*) is formed by melting a leading end of the large-diameter section (32) and a leading end of the coil (35).

A third aspect of the present invention is a high pressure discharge lamp (1) including: a bulb (2); and a pair of the electrodes (3) for a high pressure discharge lamp according to the first or second aspect, the electrodes provided in the bulb so as to face each other.

A fourth aspect of the present invention is a method for manufacturing an electrode for a high pressure discharge lamp, including the steps of: cut processing a leading end side of a large-diameter section of an electrode core bar including a small-diameter section and the large-diameter section (S110, S210); covering a portion subjected to the cut processing with a coil (S120, S220); and forming a leading end portion by melting a leading end of the large-diameter section and a leading end of the coil (S130, S230).

Here, the portion subjected to the cut processing may have a constant outer diameter, or may have a tapered shape which becomes smaller in diameter toward the leading end side.

MODES FOR CARRYING OUT THE INVENTION

Figure 1:
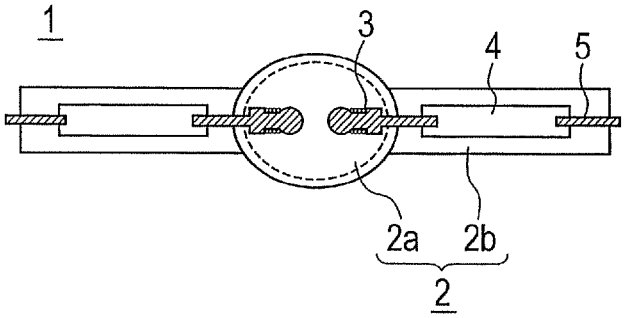
FIG. 1 is a view showing a high pressure discharge lamp of the present invention.
Figure 9:
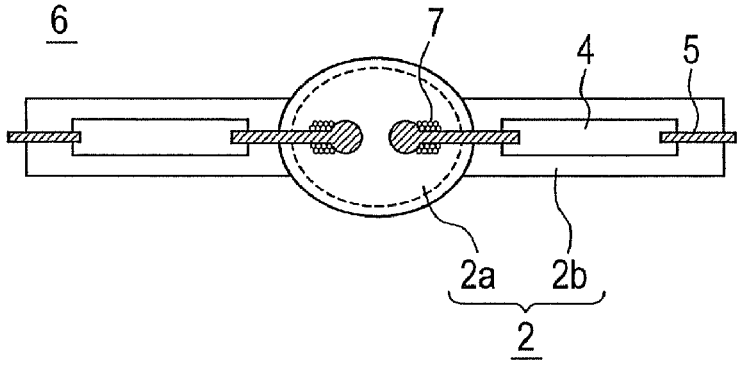
FIG. 9 is a view showing a general high pressure discharge lamp.
Figure 10A:
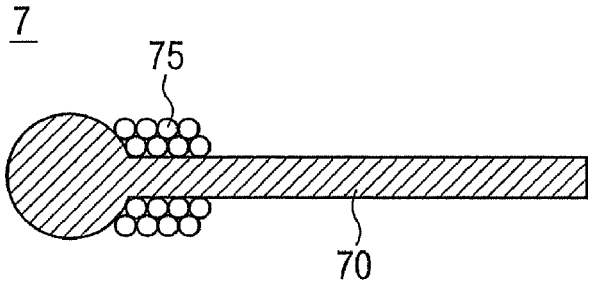
FIG. 10A is a cross-sectional view showing a structure of a conventional electrode.
Figure 10B:
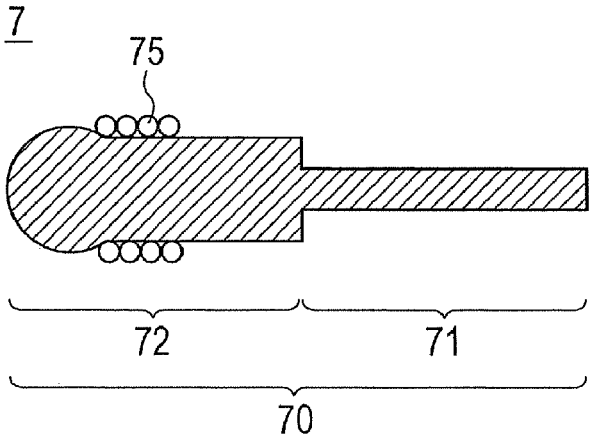
FIG. 10B is a cross-sectional view showing the structure of the conventional electrode.

FIG. 1 shows a high pressure discharge lamp 1 of the present invention. The high pressure discharge lamp 1 is different from the conventional example of FIG. 9 only in the structure of electrodes 3. A bulb 2, molybdenum foils 4, leads 5, and the overall configurations thereof are the same as those in FIG. 9. Thus, description thereof will be omitted.

Embodiment 1

Figure 2:
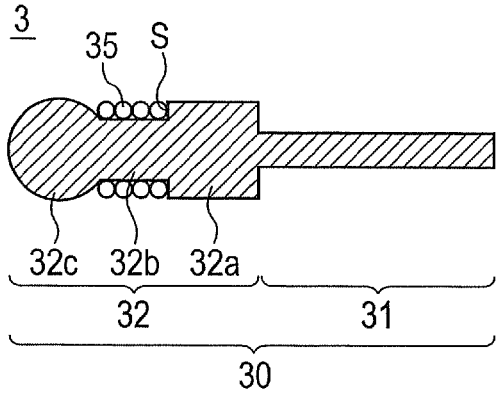
FIG. 2 is a cross-sectional view showing a structure of an electrode of a first embodiment of the present invention.

FIG. 2 is a cross-sectional view showing a structure of the electrode 3 of a first embodiment. The electrode 3 includes an electrode core bar 30 and a coil 35. The electrode core bar 30 includes a small-diameter section 31 on the power supply side and a large-diameter section 32 on the leading end side. The large-diameter section 32 includes a large-diameter portion 32*a*, a small-diameter portion 32*b*, and a leading end portion 32*c*. The coil 35 covers the small-diameter portion 32*b*. Accordingly, a step S formed by the large-diameter portion 32*a* and the small-diameter portion 32*b* restricts the movement of the coil 35 toward the small-diameter section 31 (rightward in the drawing).

Figure 3:
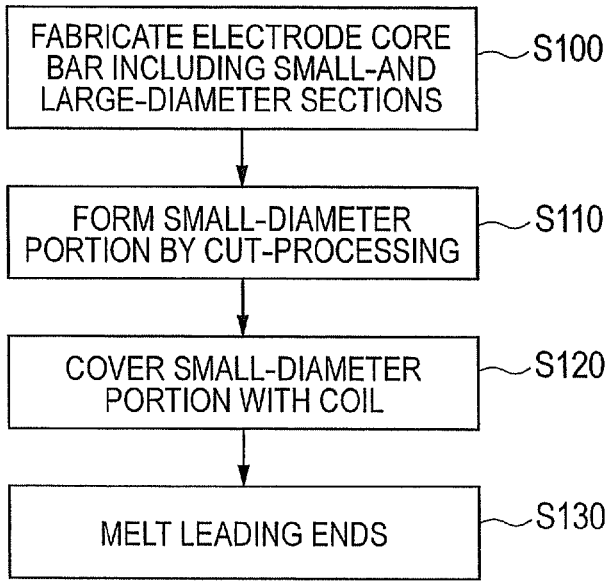
FIG. 3 is a view illustrating a method for manufacturing the electrode of the first embodiment.

FIG. 3 shows a method for manufacturing the electrode of FIG. 2.

Figure 4A:
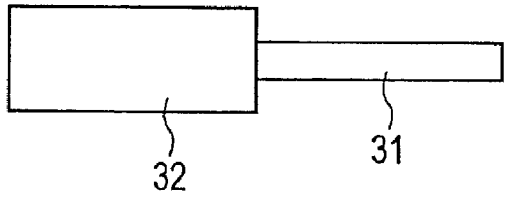
FIG. 4A is a view for explaining the method for manufacturing the electrode of the first embodiment.

In Step S100, an electrode core bar including the small-diameter section 31 and the large-diameter section 32 as shown in FIG. 4A is fabricated.

Figure 4B:
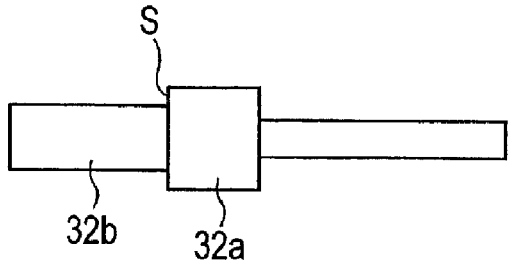
FIG. 4B is a view for explaining the method for manufacturing the electrode of the first embodiment.

In Step S110, as shown in FIG. 4B, the large-diameter section 32 is cut-processed to form the small-diameter portion 32*b*, and the step S is thus formed between the small-diameter portion 32*b* and the large-diameter portion 32*a*.

Figure 4C:
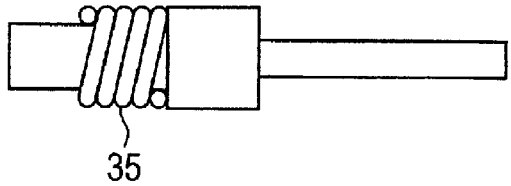
FIG. 4C is a view for explaining the method for manufacturing the electrode of the first embodiment.

In Step S120, as shown in FIG. 4C, the small-diameter portion 32*b* is covered with the coil 35, and the terminal end position of the coil 35 is determined by the step S.

Here, in Step S120, the covering of the small-diameter portion 32*b* with the coil 35 may be performed in any of the following ways. The coil 35 previously wound into an air-core shape may be fitted onto the small-diameter portion 32*b* and stopped at the step S. Alternatively, a wire material for coil may be wound around the small-diameter portion 32*b*.

Note that, considering the mounting of the coil in the present description, the term "covering" refers to both cases of "fitting" and "winding" described above.

Figure 4D:
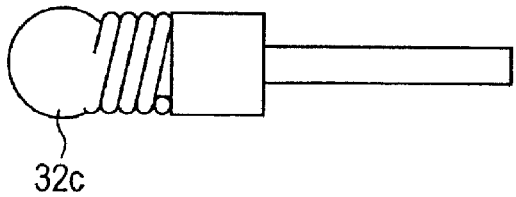
FIG. 4D is a view for explaining the method for manufacturing the electrode of the first embodiment.

In Step S130, the leading end of the small-diameter portion 32*b* and the leading end of the coil 35 are melted, and thus the dome-shaped leading end portion 32*c* is formed as shown in FIG. 4D.

As a result of the above-described steps, an electrode is manufactured having a configuration in which the coil 35 is interposed between the step S and the leading end portion 32*c*.

Note that, FIGS. 4A to 4D are schematic views for explanation. The dimension of each portion, the number of turns of the coil, and the like are not limited to those illustrated.

The above configuration allows the terminal end of the coil 35 to be fixed at the step S, and prevents spring-back from occurring. Accordingly, the discharging is made to behave stably throughout the life.

Moreover, all of the steps in the above manufacturing method are suitable for mass production, and only one melting step of Step S130 is required. Thus, high manufacturing efficiency or mass productivity can be guaranteed.

In addition, the terminal end position of the coil 35 is determined by the cut processing by which highly accurate positioning can be made. Thus, variations among individual electrodes due to the terminal end positions of the coils can be eliminated.

Embodiment 2

Figure 5:
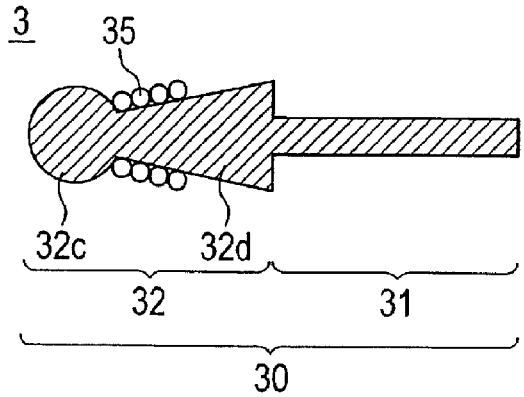
FIG. 5 is a cross-sectional view showing a structure of an electrode of a second embodiment of the present invention.

FIG. 5 is a cross-sectional view showing a structure of the electrode 3 of a second embodiment. The electrode 3 includes the electrode core bar 30 and the coil 35. The electrode core bar 30 includes the small-diameter section 31 on the power supply side and the large-diameter section 32 on the leading end side. The large-diameter section 32 includes a tapered portion 32*d* and the leading end portion 32*c*. The coil 35 covers the leading end side of the tapered portion 32*d*. The tapered portion 32*d* restricts the movement of the coil 35 toward the small-diameter section 31 (rightward in the drawing).

Figure 6:
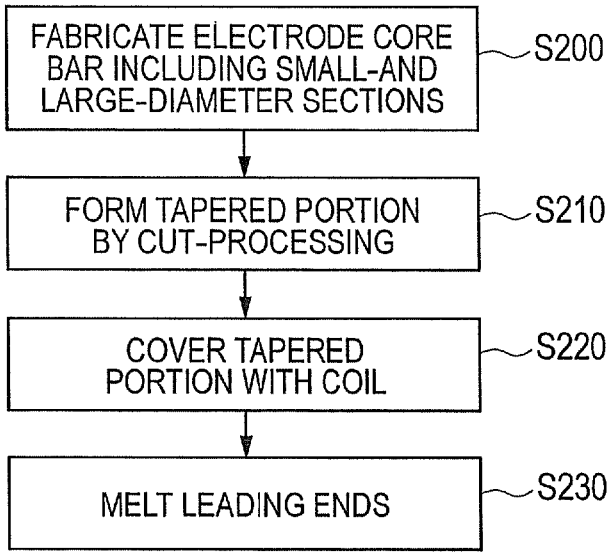
FIG. 6 is a view illustrating a method for manufacturing the electrode of the second embodiment.

FIG. 6 shows a method for manufacturing the electrode of FIG. 5.

Figure 7A:
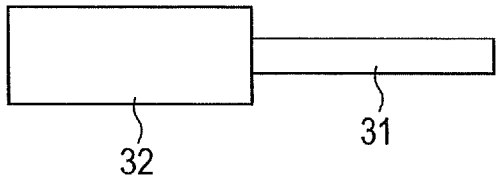
FIG. 7A is a view for explaining the method for manufacturing the electrode of the second embodiment.
Figure 7B:
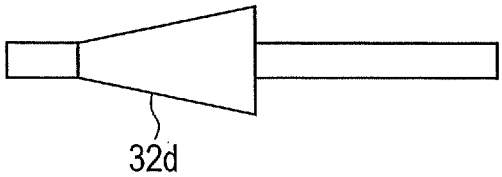
FIG. 7B is a view for explaining the method for manufacturing the electrode of the second embodiment.

In Step S200, an electrode core bar including the small-diameter section 31 and the large-diameter section 32 as shown in FIG. 7A is fabricated and provided.

In Step S210, as shown in FIG. 78, the large-diameter section 32 is cut-processed to form the tapered portion 32*d*.

Figure 7C:
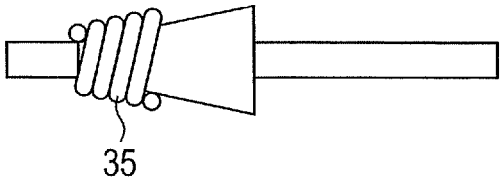
FIG. 7C is a view for explaining the method for manufacturing the electrode of the second embodiment.

In Step S220, as shown in FIG. 7C, the tapered portion 32*d* is covered with the coil 35.

Note that, in Step S220, the covering of the tapered portion 32*d* with the coil 35 may be performed in any of the following ways. The coil 35 previously wound into an air-core shape that conforms to the tapered portion 32*d* may be fitted onto the tapered portion 32*d*. Alternatively, a wire material for coil may be wound around the tapered portion 32*d*.

Figure 7D:
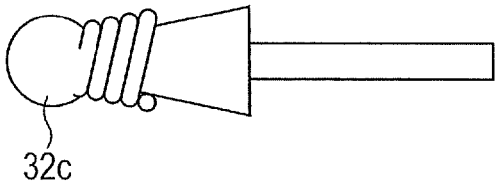
FIG. 7D is a view for explaining the method for manufacturing the electrode of the second embodiment.

In Step S230, the leading end of the tapered portion 32*d* and the leading end of the coil 35 are melted, and thus the dome-shaped leading end portion 32*c* is formed as shown in FIG. 7D.

Note that, FIGS. 7A to 7D are schematic views for explanation. The dimension of each portion, the number of turns of the coil, and the like are not limited to those illustrated.

The above configuration allows the tapered portion 32*d* to suppress spring-back of the coil 35. Accordingly, the discharging is made to behave stably throughout the life.

Moreover, all of the steps in the above manufacturing method are suitable for mass production, and only one melting step of Step S230 is required. Thus, high manufacturing efficiency or mass productivity can be guaranteed.

<Modifications>

It should be noted that various modifications can be configured as a structure of the electrode 3 by appropriately combining the configuration shown in Embodiment 1 provided with the step and the configuration shown in Embodiment 2 provided with the taper. In other words, as long as the movement (toward the small-diameter section) of the terminal end portion of the coil is restricted by the step or the taper in the large-diameter section, the object of the present invention can be achieved.

Figure 8A:
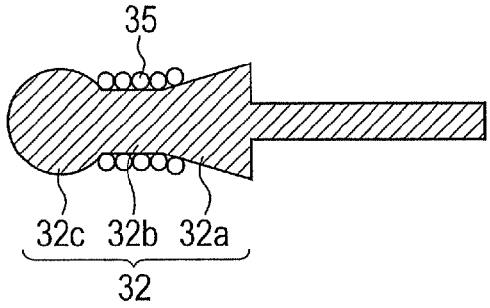
FIG. 8A is a cross-sectional view showing a modification of the present invention.

For example, as shown in a cross-sectional view of FIG. 8A, a large-diameter portion 32*a* and a small-diameter portion 32*b* may be formed in a large-diameter section 32, and the large-diameter portion 32*a* may be formed into a tapered shape.

Figure 8B:
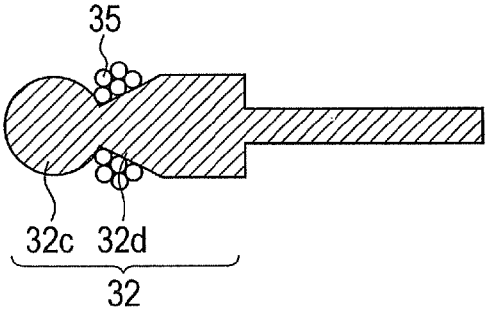
FIG. 8B is a cross-sectional view showing a modification of the present invention.

Moreover, as shown in a cross-sectional view of FIG. 8B, a tapered portion 32*d* may be provided in a portion of a large-diameter section 32.

Effects obtained by these two modifications are similar to those of the first and second embodiments.

Figure 8C:
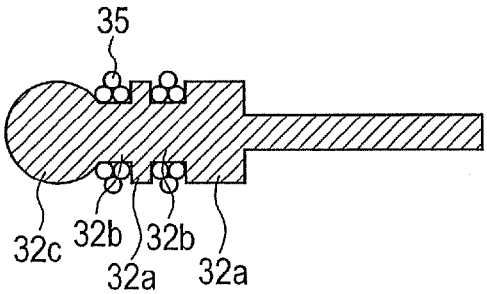
FIG. 8C is a cross-sectional view showing a modification of the present invention.
Figure 8D:
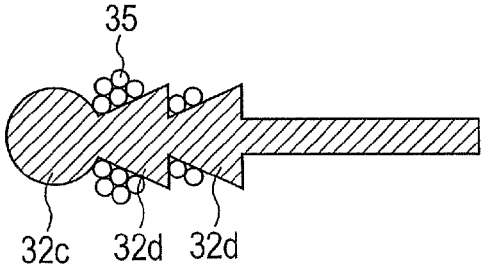
FIG. 8D is a cross-sectional view showing a modification of the present invention.

Furthermore, as shown in a cross-sectional view of FIG. 8C, multiple large-diameter portions 32*a* and small-diameter portions 32*b* may be provided in a large-diameter section, and each of the small-diameter portions may be covered with a coil. Alternatively, as shown in a cross-sectional view of FIG. 8D, multiple tapered portions 32*d* may be provided in a large-diameter section, and each of the tapered portions may be covered with a coil. In these cases, the covering is performed by wounding the coils. Effects similar to those of the first or second embodiment can be obtained in these modifications. In addition, when the coils are wound in multiple layers, variations in height direction of the layers due to winding can be suppressed.

Note that, modifications are not limited to those shown in FIGS. 8A to 8D.

According to the above configurations, high manufacturing efficiency can be achieved, and the configurations are suitable for mass production. In addition, the spring-back of the electrode coil can be surely prevented.

Moreover, the terminal end position of the coil is determined by the cut processing by which highly accurate positioning can be made than in the melt processing. Thus, variations among individual electrodes due to the terminal end positions of the coils can be eliminated.

EXPLANATION OF REFERENCE NUMERALS

1. high pressure discharge lamp
2. bulb
2*a*. light emitting part
2*b*. sealing part
3. electrode
4. molybdenum foil
5. lead
30. electrode core bar
31. small-diameter section
32. large-diameter section
32*a*. large-diameter portion
32*b*. small-diameter portion
32*c*. leading end portion
32*d*. tapered portion
35. coil
S: step

The invention claimed is:

1. An electrode for a high pressure discharge lamp, the electrode comprising: an electrode core bar; and a coil covering the electrode core bar, wherein the electrode core bar includes: a small-diameter section on a power supply side; and a large-diameter section on a leading end side, the large-diameter section has: a large-diameter portion on the small-diameter section side; a small-diameter portion having a smaller outer diameter than the large-diameter portion, the small-diameter portion forming a step with the large-diameter portion therebetween; and a leading end portion, the coil covers a portion between the step and the leading end portion, and the leading end portion is formed by melting a leading end of the large-diameter section and a leading end of the coil.

2. The electrode for a high pressure discharge lamp according to claim 1, wherein the small-diameter portion is formed by cut processing.

3. A high pressure discharge lamp comprising: a bulb; and a pair of the electrodes for a high pressure discharge lamp according to claim 2, the electrodes provided in the bulb so as to face each other.

4. A high pressure discharge lamp comprising: a bulb; and a pair of the electrodes for a high pressure discharge lamp according to claim 1, the electrodes provided in the bulb so as to face each other.

5. An electrode for a high pressure discharge lamp, the electrode comprising: an electrode core bar; and a coil mounted on the electrode core bar, wherein the electrode core bar includes: a small-diameter section on a power supply side; and a large-diameter section on a leading end side, the large-diameter section has: a leading end portion; and a tapered portion which becomes smaller in diameter from the small-diameter section toward the leading end, the coil covers the tapered portion, and the leading end portion is formed by melting a leading end of the large-diameter section and a leading end of the coil.

6. The electrode for a high pressure discharge lamp according to claim 5, wherein the tapered portion is formed by cut processing.

7. A high pressure discharge lamp comprising: a bulb; and a pair of the electrodes for a high pressure discharge lamp according to claim 5, the electrodes provided in the bulb so as to face each other.

8. A method for manufacturing an electrode for a high pressure discharge lamp, comprising the steps of:

cut processing a leading end side of a large-diameter section of an electrode core bar including a small-diameter section and the large-diameter section;

covering a portion subjected to the cut processing with a coil; and forming a leading end portion by melting a leading end of the large-diameter section and a leading end of the coil together.

9. The manufacturing method according to claim 8, wherein the portion subjected to the cut processing has a constant outer diameter.

10. The manufacturing method according to claim 8, wherein the portion subjected to the cut processing has a tapered shape which becomes smaller in diameter toward the leading end side.

* * * * *